United States Patent [19]

Kinkelaar et al.

[11] Patent Number: 4,550,037

[45] Date of Patent: Oct. 29, 1985

[54] TIN PLATING IMMERSION PROCESS

[75] Inventors: Edmund W. Kinkelaar, Dublin; Howard G. Pekar, Columbus, both of Ohio

[73] Assignee: Texo Corporation, Cincinnati, Ohio

[21] Appl. No.: 682,749

[22] Filed: Dec. 17, 1984

[51] Int. Cl.[4] ..... B05D 1/18

[52] U.S. Cl. ..... 427/443.1; 427/436; 427/437

[58] Field of Search ..... 427/436, 437, 443.1

[56] References Cited

U.S. PATENT DOCUMENTS

| | | | |
|---|---|---|---|
| 3,971,861 | 7/1976 | de Waltoff | 427/438 X |
| 4,194,913 | 3/1980 | Davis | 427/436 X |
| 4,206,264 | 6/1980 | Kurr | 427/436 X |
| 4,405,663 | 9/1983 | Kinkelaar et al. | 427/436 X |

*Primary Examiner*—James R. Hoffman

*Attorney, Agent, or Firm*—Francis T. Kremblas, Jr.

[57] ABSTRACT

A method for coating tin on an electro-conductive substrate in a bath comprising stannous ions, a mineral acid and a non-ionic surfactant consisting of nonylphenoxypoly (ethyleneoxy) ethanol. A catalyst metal comprising metallic zinc or zinc alloy and the substrate to be coated are immersed in the bath. During this immersion electroconductive contact is effected between the substrate and zinc or zinc alloy. A smooth, pore-free, pure tin coat is deposited on the substrate during the time the substrate is in electro-conductive contact with the zinc or zinc alloy.

7 Claims, No Drawings

TIN PLATING IMMERSION PROCESS

BACKGROUND

The present invention relates to an improved immersion process for plating tin on ferrous, non-ferrous, or other electro-conductive substrates.

There are many prior art methods for electroplating and for electroless or immersion plating of tin or tin alloys upon substrates. However, interest has increased over the last several years toward electroless methods because of environmental concerns and energy costs. However, prior art immersion techniques have not been able to satisfactorily overcome one or more deficiencies such as extended processing time, the elimination of porosity of the tin coat or uneconomic processing conditions. Some prior processes require a permanent zinc undercoat on the substrate such as disclosed in U.S. Pat. No. 4,405,663.

While useful, this process does not produce a pore-free coating and is limited to plating over a zinc coated surface.

Other prior processes are not satisfactory in certain applications because the deposited coating is not pure tin but include other elements or compounds. Examples of such prior art include U.S. Pat. Nos. 3,971,861 and 4,194,913.

Further prior art drawbacks include porous or poorly adherent tin coats. Others are very limited in the thickness of the tin coat applied. Many prior processes require the immersion bath heated to relatively high temperatures to obtain economically practical rates of deposit. Some processes are subject to hydrogen embrittling of the substrate or are applicable to only a specific metal or narrow range of metal substrates.

The many prior attempts have yet to provide an electroless immersion process which produces a heavy, pure, pore-free and smooth, non-granular tin coating at efficient rates of deposit in a relatively simple and easily controlled process.

SUMMARY OF THE INVENTION

The present invention relates to an immersion process for depositing a tin coating on a metal or other electro-conductive substrate in a bath comprising stannous ions, a strong mineral acid and a non-ionic surfactant consisting of nonylphenoxy-poly (ethyleneoxy) ethanol. Metallic zinc or a zinc alloy is placed in the bath and functions as a catalyst wherein mere electro-conductive contact between the zinc and substrate to be coated effects the deposit of tin onto the substrate.

As used herein and for purposes of distinguishing certain prior art processes, the contact or engagement between the catalyst metal and the substrate does not have to be a permanent attachment and preferably is merely direct touching or indirect temporary connection via an electro-conductive medium.

Within the operative range of bath compositions and with an appropriate amount of metallic zinc supplied to the bath, the tin coating deposited has been found to be pore-free and smooth with excellent adherence to the substrate. The thickness of the tin coating practicing the process of the present invention is limited only by the operating time and economically practical results.

The immersion bath comprises a composition range of the following components: 3 to 70 grams of stannous ion per liter of water; 10 to 200 grams of a strong mineral acid, such as sulfuric acid; and 0.1 to 10 grams of a nonylphenoxy-poly (ethyleneoxy) ethanol, having a molecular weight ranging from about 484 to 2400 per liter of water.

The metallic zinc or zinc alloy used may be in the form of a single discrete piece or a plurality of such pieces. The size range includes powder or dust, a small, thin sheet or strip form or a large sheet or block depending upon the particular application. The zinc is directly or indirectly disposed in electro-conductive contact with the substrate to be coated while both are immersed in the bath. This contact between the zinc and the substrate may be continuous during the processing time or consist of numerous intermittent contacts.

The bath operating temperature ranges from 50 to 110 degrees F. and the process works very well within typical ambient room temperature ranges.

The bath possesses a long operating life of at least six months or more in typical applications (with regular replenishment) and is stable in normal environments and at ambient temperature ranges.

OBJECTS

It is primary object of the present invention to provide an electroless immersion process for tin coating electro-conductive substrates wherein the tin coating is pore-free, smooth and adherent.

It is another object of the present invention to provide a process of the type described which uses metallic zinc or zinc alloys in the plating bath in the form of independent pieces which function as a catalyst when disposed in electro-conductive contact with the substrate to be coated to effect the deposit of the tin coat onto the substrate.

It is another object of the present invention to provide a process of the type described wherein the bath composition contains no cyanides, or toxic metals or other highly undesirable environmental components.

It is a further object of the present invention to provide a process of the type described wherein the bath may be operated at ambient room temperature, has a long useful life and the spent bath can be reclaimed for any residual metal content in a relatively economical manner.

It is still another object of the present invention to provide a process of the type described wherein the tin coating is pure, that is, free of alloys or other contaminants and wherein the thickness of the tin coat is essentially not limited except for practical and economical reasons for a given application.

Further objects and advantages of the present invention will be apparent from the following description, wherein preferred forms of embodiments and examples of the invention are clearly described.

DETAILED DESCRIPTION

The present invention relates to an improved electroless tin plating immersion process for depositing a pure tin coat on ferrous or non-ferrous metals and on other electro-conductive substrates.

It has been discovered that a heavy, pore-free tin coat may be applied to such substrates while the substrate and a catalyst metal consisting of zinc or a zinc alloy is merely placed in direct or indirect electro-conductive contact with the substrate to be coated while both are immersed in the bath. Therefore, unlike prior processes of this kind, no undercoat of zinc or other metal need be applied to the substrate to obtain an overplate of pure tin. Also no mechanical impingement is necessary to effect an adherent tin coating. As used herein, "zinc" includes zinc alloys.

The electro-conductive contact required in the present invention may be effected by direct metal to metal contact between the zinc and the substrate or by indirect electro-conductive contact through an electro-conductive intermediary such as another piece of metal or a metallic wire or strip in contact with both the zinc and the substrate. Tin is deposited only during the time electro-conductive contact between the substrate and zinc is effected.

In some applications, it is desirable that the electro-conductive contact be applied in an intermittent random fashion, such as by tumbling pieces of zinc and small metallic articles to be coated within the bath to cause random intermittent electro-conductive contact between the substrate articles and the zinc.

The bath composition operable in accordance with the present invention is advantageous in that it does not employ cyanides or toxic metals or other environmentally hazardous components which create difficult handling and disposal problems. In accordance with the present invention, the immersion plating bath comprises the following composition: stannous ion in an amount ranging from 3 to 70 grams per liter of water; 10 to 200 grams of a strong mineral acid, preferably sulfuric acid; and 0.1 to 10 grams of nonylphenoxy-poly (ethyleneoxy) ethanol having a molecular weight in the range of about 484 to 2400.

The concentration of the mineral acid should be high enough to assure that the stannous ions remain in solution and prevent the formation of insoluble tin hydroxy or complex oxy compounds which remove tin from the solution.

The preferred acid concentration for the present invention is between about 30 to 80 grams per liter of water.

For purposes of the present invention, a smooth, pore-free tin coating which is not granular is desired. Generally higher concentration levels of stannous ion available in the solution increase the rate of deposition within the ranges disclosed herein. In the lower ranges of concentration levels of stannous ion, a longer immersion time is required to assure a pore-free tin coat is deposited. The preferred range of stannous ion in accordance with the present invention is between about 12 to 20 grams of stannous ion per liter of water and very good to excellent results have been obtained within this preferred range relative to smooth, non-granular and pore-free coatings deposited in relatively short processing times.

The preferred concentration range for the non-ionic surfactant, nonylphenoxy-poly (ethylenoxy) ethanol, is about 0.5 to 3 grams per liter of water. Also the preferred molecular weight range of this non-ionic surfactant is between about 484 to 1000.

The immersion plating bath used in the practice of the present invention works well between about 50 to 110 degrees F. which is within typical ambient temperatures. While the rate of deposition of tin increases with temperature, at about 100 degrees F. and higher, it becomes more difficult to maintain the solubility of the stannous ions in the bath. As the bath temperature is elevated beyond 100 to 110 degrees F. the tendency toward the formation of insoluble tin hydroxy or complex oxy compounds significantly increases until significant and considerable loss of stannous ions result. Therefore it is not necessary and generally not desirable to heat the bath to relatively high temperatures as required in many prior processes.

The bath is stable over a relatively long useful period of at least six months under typical replenishment conditions. When the concentration of zinc ions in solution nears the saturation point, a fresh bath should be used. The bath tolerates relatively high levels of zinc ions in solution. At 10 grams per liter of zinc ions in solutions and even higher, the process still works well in accordance with the present invention. Concentration of the primary components of the bath may be controlled easily by titration.

In accordance with the present invention, a pure tin coat may be deposited which is pore-free, as measured by the standard General Motors test method 9074-P, once a minimum thickness of coat is deposited. The bath composition has excellent throwing power into holes or the like and over a distance 12 inches or more measured from the electro-conductive point of contact between the substrate and the zinc catalyst metal.

The basic operating premise of the present invention does not limit the thickness of the tin coat. As long as sufficient stannous ions and sufficient metallic zinc remain in the bath, the tin will continue to be deposited upon the substrate until the concentration of zinc ions in solution nears saturation and the bath becomes spent.

Corrosion tests of the tin coatings applied in accordance with the present invention have indicated that they are equivalent to cadmium plated fasteners. Torque tension tests indicate that tin coatings applied in accordance with the present invention are equivalent to the standard cadmium and wax coating on fasteners.

Since the tin coat is only deposited when the zinc and substrate are in electro-conductive contact, selective placement of the tin coat can be esily and precisely achieved upon a given substrate by means of insulating masks or the like. Since pure tin is FDA approved, tin coating applications for food containers utilizing the present invention appear very desirable.

It has been found that prior preparation of metallic substrates to be coated for purposes of the present invention can be achieved using the conventional steps currently used to prepare metal for applying corrosion resistant phosphate coatings.

Typical examples of the present invention are described below.

EXAMPLE I

A ferrous substrate in sheet form was immersed in a bath at room temperature (75 degrees F.). Four strips of metallic zinc were connected to the opposing edges of the ferrous substrate by copper wire extended through holes provided in the substrate and zinc strips.

The substrate was prepared beforehand by conventional cleaning and descaling steps previously referred to herein. These steps included alkaline cleaning followed by a water rinse; an alkaline descaling followed by a water rinse; and finally an organic pickle and water rinse. The substrate was then ready for the coating process.

The immersion bath composition was as follows:

Stannous Sulfate—27 g/L

Sulfuric Acid—70 g/L

IGEPAL CO 630—1 g/L (IGEPAL CO 630 is the brand name of a nonylphenoxy-poly (etheneoxy) ethanol commercially available from GAF Corporation)

Water—Balance

The ferrous substrate and zinc were immersed in the bath for five minutes. A smooth, adherent, pore-free tin coating was deposited on the substrate and was measured to be 1,142 mg per square foot of substrate surface and had an average thickness of 1.67 Microns.

EXAMPLE II

Using the same conditions and steps as described in Examiner I, a similar ferrous substrate and zinc catalyst strips were immersed in the bath for one minute. A similar tin coating was deposited on the substrate which was calculated to be 293 mg per square foot having an average depth of 0.43 Microns.

EXAMPLE III

Utilizing the same preparation steps, bath composition and bath temperature, a plurality of metallic fasteners, screws and bolts were placed in a porous rotating barrel with several strips of galvanized steel. The barrel was then immersed in the bath and rotated to cause random mixing and contact between the various parts and galvanized steel strips for five minutes. After this five minute immersion, the barrel was removed and the fasteners, screws and bolts were rinsed and than given a one minute dip in a solution of calcium chromate.

Visual inspection indicated a relatively heavy, smooth tin coat on each of the parts. The parts were dried and oiled using Tectyl 603 prior to applying a salt spray. Inspection of these parts after 168 hours showed no signs of rust.

Each of the resultant coatings obtained in Examples I, II and III were determined to be pore-free as measured by General Motors test method GM9079-P which is a generally accepted standard for determining the integrity of coatings over ferrous substrates in the automotive industry.

The effect of the operating parameters of the bath concentration on the tin coat process has been investigated.

The study of molecular weight ranges of the surfactant covered the full range of the Igepal CO series of surfactants available from the GAF corporation which are water soluble. This study revealed that the lower molecular weight range between about 484 to 1000 is preferred relative to obtaining higher efficiency of the zinc catalyst metal. In this lower molecular weight range, the tin coat which is also deposited on the zinc during this process has good adherence but is more porous. Since the process of the present invention requires displacement of zinc ions into the solution, a sufficient amount of metallic zinc surface area is necessary to maintain adequate rates of deposit without resupplying the bath with fresh catalyst metal. The higher molecular weight surfactants tend to reduce the porosity of the tin coat deposited upon the zinc which tends to more readily limit the useful life of the initial zinc catalyst metal in the bath. However, the nature and the rate of the tin coat deposited on the substrate is not appreciably effected as long as an adequate exposed metallic zinc catalyst surface area is available to permit zinc ions to be displaced into the bath.

The effect of the concentration of the surfactant was studied and it was found that the lower limits of the ranges disclosed tended to make the deposits of tin on the zinc catalyst more granular and more porous. This is desirable in the present invention as it permits a greater surface area of exposed metallic zinc to remain for a longer time and therefore increases the useful life of the zinc catalyst in accordance with the present invention.

Further, it should be noted that the surfactant provides a significant control of the rate of deposition of the tin. Without a sufficient concentration of this surfactant, the tin tends to deposit very rapidly upon the zinc catalyst metal and substrate in a poorly structured, non-adherent mud-like coating which is generally undesirable for purposes of the present invention. This represents a waste of the expensive stannous ions and further interferes with the desired processing procedure.

The effect of the concentration of sulfuric acid was studied and it was found that the range of concentration is determined by the amount necessary to prevent formation of insoluble tin hydroxy or complex oxy compounds in relation to the amount of stannous ions in solution. The higher acid concentration range of over 100 g per liter is sufficient to maintain the practical upper concentration limits of stannous ions in solution.

The acid concentration did not appear to have any appreciable effect on the nature of the tin deposit on the substrate within the concentration ranges disclosed herein.

A study of the effect of the stannous ion concentration within the ranges of about 3 to 70 grams per liter of water revealed that increasing the concentration of stannous ions increases the rate of deposition of the tin coat. At the lower concentration levels within the noted range, it took proportionately longer to obtain a pore-free tin coat. It has been found that a pore-free coat is obtained once the coat thickness has reached approximately 0.023 mils.

A concentration above about 100 grams per liter of stannous ions cannot be maintained. At such high concentrations, the stannous ions tend to precipitate out of solution as tin oxy compounds and/or tin hydroxide.

In addition to the specific examples noted herein, it should be pointed out that different means may be employed to effect the required electro-conductive contact between the zinc catalyst metal and the substrate to be coated in order to obtain a particular desired result for a given application.

In the present process, the tin coat deposited on the substrate to be coated tends to be slightly thicker at points closest to the point of electro-conductive contact between the zinc and the substrate.

This is termed a "wedge" effect. However, where suitable for a given application, this can be minimized to provide a more uniform coating thickness by providing a plurality of stationary points of contact or by providing a high number of random, intermittent contacts, such as tumbling in a porous barrel as described in Example III.

A further means to effect the desired contact between the substrate and zinc could be obtained by providing a porous zinc barrel into which the parts to be coated are placed. Then the immersed zinc barrel with the substrate parts may be rotated to provide a high number of random intermittent contacts between the parts to be coated and the zinc barrel.

In addition to the other applications noted herein, the process of the present invention may be employed to advantage for selective tin coating on printed circuit boards, high speed coatings for wire and on aluminum pistons or other friction bearing parts to reduce friction.

In view of the foregoing description it should be readily apparent that the present invention provides a novel immersion tin plating process which represents a very significant advance in the art and provides many advantages not found in prior art teachings.

What is claimed is:

1. In a method for coating an electro-conductive substrate with tin, the steps of (1) immersing the substrate to be coated and one or more pieces of metallic zinc in a bath having the following composition:

(a) approximately 3 to 70 grams of stannous ions per liter of water;

(b) approximately 10 to 200 grams of a strong mineral acid per liter of water, the concentration of said acid being sufficient to maintain the stannous ions in solution in the bath; and (c) 0.1 to 10 grams of nonylphenoxy-poly (ethyleneoxy) ethanol having a molecular weight ranging from about 484 to 2400.

(2) effecting electro-conductive contact between the substrate to be coated and the metallic zinc immersed in said bath for a pre-determined length of time related to the thickness of the tin coating to be deposited on the substrate; (3) operating said bath at a temperature between approximately 50 to 110 degrees F.; (4) removing the substrate coated with tin from the bath.

2. A method according to claim 1 wherein the mineral acid in said bath is sulfuric acid in a concentration of 30 to 80 grams per liter of water.

3. A method according to claim 1 wherein the stannous ion concentration is about 12 to 20 grams per liter of water.

4. A method according to claim 1 wherein said nonylphenoxy-poly (ethyleneoxy) ethanol has a molecular weight of about 484 to 1000 and a concentration ranging from about 0.5 grams to 3 grams per liter of water.

5. A method according to claim 1 including effecting relative motion between the substrate to be coated and the metallic zinc while immersed in said bath to cause electro-conductive contact between said substrate and said zinc to occur in a random, intermittent and repetitive manner.

6. A method according to claim 5 wherein the substrate to be coated consists of a plurality of individual items and said substrate items and a plurality of metallic zinc pieces are tumbled in said bath in a manner to induce random electro-conductive contact between the substrate items and the zinc.

7. A method according to claim 5 wherein said metallic zinc is in the form of a porous, generally barrel shaped, container and a plurality of substrates to be coated are placed within said container and said container is immersed and rotated within said bath.

* * * * *